United States Patent [19]

Dreibelbis

[11] 4,005,804

[45] Feb. 1, 1977

[54] MULTI-CONTROL VALVE DISPENSING HEAD AND HEATED AND CHILLED WATER DISPENSING SYSTEM UTILIZING THE SAME

[75] Inventor: Richard C. Dreibelbis, Fair Lawn, N.J.

[73] Assignee: Emerson Electric Co. (H & H Thermostats Div), St. Louis, Mo.

[22] Filed: Dec. 15, 1975

[21] Appl. No.: 640,408

[52] U.S. Cl. ..... 222/144.5; 222/146 R

[51] Int. Cl.[2] ..... B67D 5/60

[58] Field of Search ..... 222/146 R, 145, 144.5, 222/383; 137/341, 599.1, 608

[56] References Cited

UNITED STATES PATENTS

| | | | |
|---|---|---|---|
| 2,734,667 | 2/1956 | Conklin | 222/383 X |
| 2,822,112 | 2/1958 | Bremer | 222/144.5 X |
| 2,823,833 | 2/1958 | Bauerlein | 222/144.5 X |

*Primary Examiner*—Stanley H. Tollberg
*Assistant Examiner*—Hadd Lane
*Attorney, Agent, or Firm*—Daniel H. Bobis

[57] ABSTRACT

A dispensing head for use in a heated water and chilled water dispensing system operated at atmospheric pressure has a valve body having a connecting means for attaching the dispensing head at a point of use generally remote from the dispensing system, said valve body has a common discharge spout for the heated water and chilled water delivered thereto from the dispensing system, a first control valve assembly having an inlet in communication with the heated water section of the dispensing system acts to control delivery of the heated fluid through a first cross-over passage in communication with the discharge spout, a second control valve assembly having an inlet in communication with the chilled water section of the dispensing system acts to control delivery of the chilled water through a second cross-over passage in communication with the discharge spout, vent means is formed in the dispensing head for venting the hot water section of the dispensing system to atmosphere, and a check valve is operatively associated with said common discharge spout to prevent any unwanted mixture of heated water and chilled water during operation of the system.

Additionally, the combination of said dispensing head as above described with a heated water and chilled water dispensing system operated at atmospheric pressure includes, a first assembly for heating and storing heated water to be dispensed from said system, a second assembly for chilling and storing chilled water to be dispensed from said system, a first conduit connecting the first control assembly to said heating and storing assembly for heated water, a second conduit for connecting the second control assembly to the chilling and storing assembly for the chilled water, and a connecting conduit to provide communication between the heated water section of the dispensing system and the vent means in the dispensing head.

23 Claims, 14 Drawing Figures

MULTI-CONTROL VALVE DISPENSING HEAD AND HEATED AND CHILLED WATER DISPENSING SYSTEM UTILIZING THE SAME

BACKGROUND OF THE INVENTION

The present invention relates generally to fluid dispensing systems and more particularly to a multi-control valve dispensing head, and to a heated and chilled water dispensing system utilizing said multi-control valve dispensing head wherein the said multi-control valve dispensing head is disposed at a point remote from the heated and chilled water dispensing system.

Instant hot water dispensing systems with remote dispensing heads which operate at atmospheric pressure are known in the prior art as is shown in U.S. Pat. Nos. 3,202,321; 3,642,176; 3,836,050, and 3,905,518.

Chilled water dispensing systems operating at atmospheric pressure with remote dispensing elements are also known in the prior art.

Efforts are now being made to provide dispensing systems operating at atmospheric pressure in which both chilled water and heated water can be dispensed at a common point remote from the respective means for chilling and heating the water or other fluid and one such system is shown in U.S. Pat. No. 3,221,806.

In the last mentioned system, as shown in U.S. Pat. No. 3,221,806 the dispensing heads for the respective heated and chilled water are separate and independent because energy losses can occur when either of the respective fluids being dispensed are brought into contract with the other fluid being dispensed from the system.

In the present invention a dispensing head is provided which has a common dispensing spout for the respective heated and chilled fluids and operatively associated therewith are separate and independent control valve assemblies for the respective heated water and chilled water so that these fluids can be dispensed independently of each other or in a mixture with each other in any desired ratio and means associated with the dispensing head is provided to prevent unwanted intermingling of the fluids during the dispensing thereof or after either or both of these fluids have been dispensed from the system.

SUMMARY OF THE INVENTION

Thus the present invention covers an improved dispensing head for heated and chilled water dispensing systems operating at atmospheric pressure comprising, a valve body having a threaded section thereon for connecting the dispensing heat at any suitable point of use remote from the dispensing system, said valve body has a common discharge spout for delivering heated water and chilled water from the dispensing head, a first cross-over passage in said valve body communicating with the discharge spout for delivering heated water to be dispensed by the discharge spout, a first normally closed control valve assembly in said valve body for controlling flow of heated water to the first cross-over passage, and means for actuating said first control valve assembly from closed to open position and from open to closed position, a second cross-over passage in said valve body communicating with the discharge spout for delivering chilled water to be dispensed by the discharge spout, a second normally closed control valve assembly in said valve body for controlling flow of chilled water through the second cross-over passage, means for actuating said second control valve assembly from closed to open position and from open to closed position, and check valve means in operative communication with the common discharge spout to prevent unwanted intermixing of heated water and chilled water during operation of the dispensing system or on termination of discharge therefrom.

Additionally, the present invention covers the combination of said above described valve with a heated water and chilled water dispensing system wherein; said heated water and chilled water dispensing system includes, a heating and storing means for heated water, a chilling and storing means for chilled water, first conduit means connecting the first control valve assembly to the heating and storing means, second conduit means connecting the second control valve assembly to the second cross-over passage, third conduit means connecting the heating and storing means to aid first cross-over passage, supply conduit means connected for delivering water to be heated to said heating and storage means and for delivering water to be chilled to said chilling and storing means, vent means in said dispensing head, and a vent conduit connecting said heated and storing means sections of the dispensing system to said vent means to maintain operation therof at atmospheric pressure.

Accordingly it is an object of the present invention to provide a multi-control valve dispensing head for dispensing heated water and chilled water preferably for use in a heated water and chilled water dispensing system.

It is another object of the present invention to provide a multi-control valve dispensing head which is connected to a sink or other kitchen facility remote from the heating and storage elements and chilling and storing elements of a heated water and chilled water dispensing system.

It is still another object of the invention to provide a multi-control valve dispensing head of the type described which communicates with a remotely positioned source of heated water and chilled water and which embodies means to prevent unwanted intermixture of heated water and chilled water during or on termination of the dispensing thereof from the dispensing head.

Other objects and advantages of the invention will become clear to those skilled in the art from the following description taken in conjunction with the accompanying drawings, in which.

Figure 1:
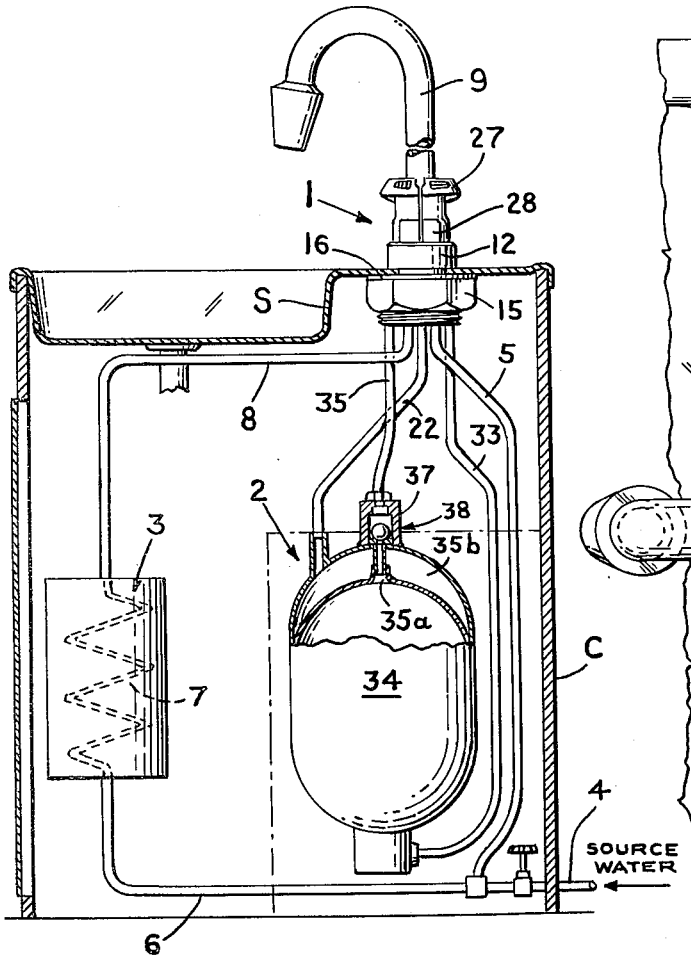
FIG. 1 is a schematic side elevation in partial cross section of a dispensing system for heated water and chilled water mounted in a sink cabinet and embodying a remote dispensing head in accordance with the present invention connected to the sink of the sink cabinet.
Figure 2:
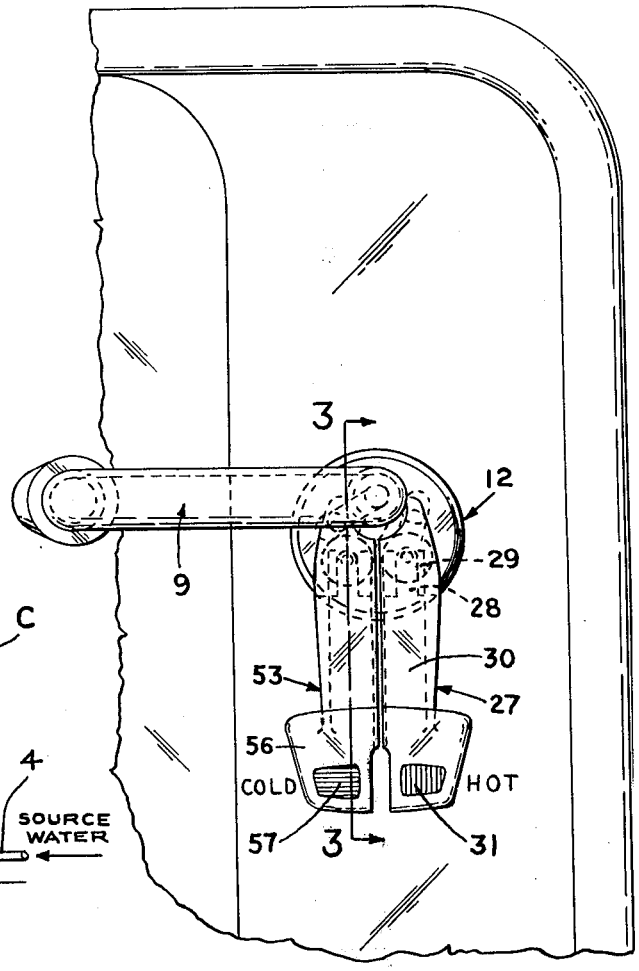
FIG. 2 is a top view of the dispensing head shown in FIG. 1 in assembled position at the point of attachment on the sink.
Figure 3:
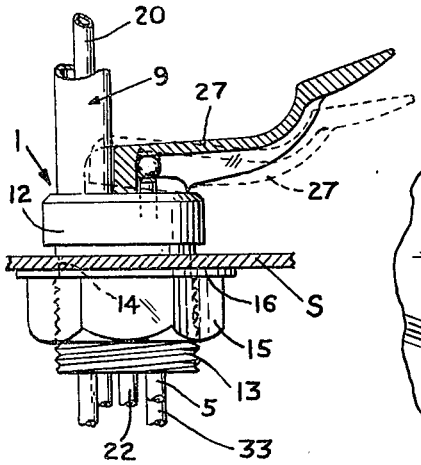
FIG. 3 is a side elevation of the dispensing head shown in FIG. 1 with only a fragment of the dispensing spout and having the chilled water operating lever in cross-section along line 3—3 of FIG. 2.
Figure 4:
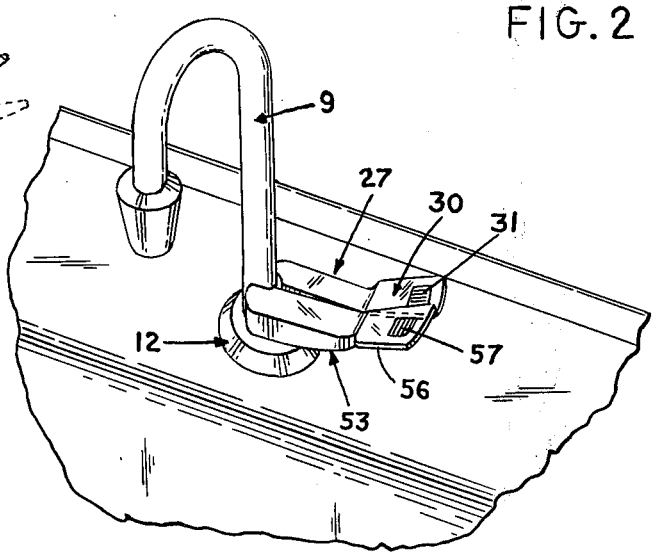
FIG. 4 is a perspective view of the dispensing head shown in FIG. 1.

Referring to the drawings FIG. 1 shows one form of dispensing system operating at atmospheric pressure which utilizes an improved dispensing head generally designated 1 in accordance with the present invention.

The dispensing system has means generally designated 2 for heating and storing the heated water to be dispensed by the dispensing head 1 and means generally designated 3 for chilling and storing the chilled water to be dispensed by the dispensing head 1 and as shown in FIG. 1 the respective heating and storing means 2 and chilling and storing means 3 are mounted in a common enclosure or cabinet C while the dispensing head 1 is disposed remotely therefrom being connected to any desired point of attachment on the associated sink S where the heated and chilled water will be dispensed.

The dispensing system will be connected to any conventional source of city water available at the site of the system which will be piped in through the usual main line 4. Water to be heated is delivered through connecting conduit 5 while that to be chilled is delivered through connecting conduit 6 each respectively connected at one end to the main line 4, as is shown in FIG. 1.

Figure 10:
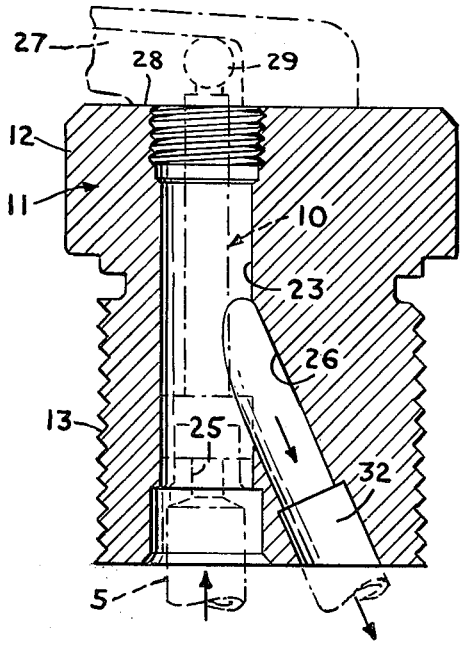
FIG. 10 is a cross-section taken on line 10—10 of FIG. 8 showing the control valve bore and heated water control valve means for controlling flow of water to be heated to the heating and storing means for the dispensing system when the heated water control valve means is actuated from closed to open position.

FIGS. 1 and 10 further shown that the connecting line 5 is connected at the end remote from the main line 4 directly to the dispensing head 1 and in the dispensing head 1 communicates with a first control valve assembly or means 10 for controlling flow of water to be heated to the heating and storing means 2.

The operation of the control valve 10 for passing water to be heated to the heating and storing means 2 is effected in the same manner as is shown and described in the instant hot water dispensing systems shown in the prior art, as in U.S. Pat. Nos. 3,202,321 and 3,480,123.

Connecting line 6 for delivering water to be chilled to the chilling and storage means 3 is connected at the end remote from the main line 4 to a heat exchange means 7 in the chilling and storage means 3 which forms part of a conventional refrigeration system, not shown, and therefore is not more fully described because such self contained refrigeration devices are well known in the art and purchaseable on the open market.

The outlet end of heat exchange means 7 is connected to a chilled water delivery line 8 which in turn is connected at the end remote therefrom to the dispensing head 1 where it communicates with a second control valve assembly or means 5 for controlling flow of chilled water to be dispensed by the dispensing head 1.

The dispensing head 1 will now be more fully described to show the operative interrelation between the first control valve means 10 for controlling flow of heated fluid, the second control valve means 50 for controlling flow of chilled fluid, and the discharge spout generally designated 9 in the dispensing head 1.

DISPENSING HEAD

Figure 7:
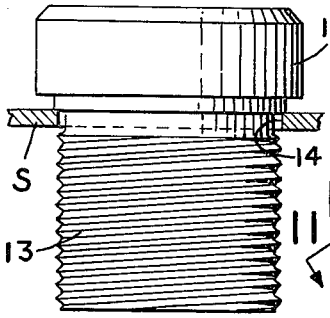
FIG. 7 is a side elevation of the valve body of the dispensing head shown in FIG. 1 of the drawings.
Figure 8:
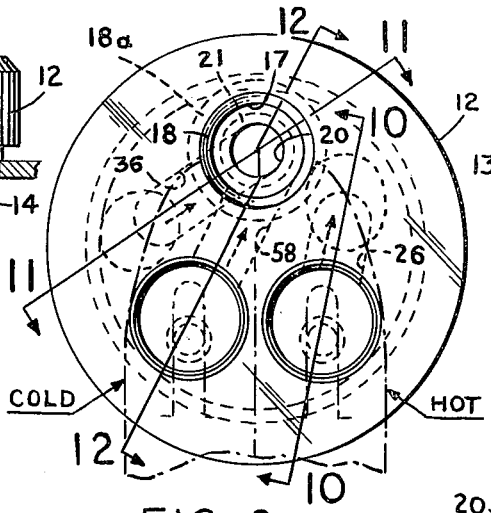
FIG. 8 is a top view of the valve body shown in FIG. 7.
Figure 9:
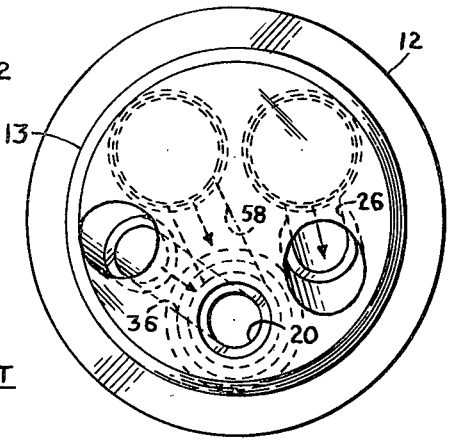
FIG. 9 is a bottom view of the valve body shown in FIG. 7.

FIGS. 1 and 7 show that the dispensing head 1 includes a valve body 11 of generally cylindrical shape which has a finished head 12 on the portion thereof which will be visible on the upper side of the sink S and a threaded portion of section 13 which provides means for mounting the dispensing head 1 through a suitable opening 14 provided in the upper surface of the sink by means of a nut 15 and a sealing gasket 16 which connects the valve body in fluid tight engagement with the upper surface of the sink S.

FIGS. 8 to 12 show that the valve body has a discharge spout bore 17 having a stop shoulder 18 inwardly of the end thereof adjacent to the exterior or finished poriton of the valve body 12.

The end of the hollow goose neck discharge spout 9 seats against shoulder 18 which permits the discharge spout to be to be mounted in the valve body 11 in any desired angular position over a range of about 120°. The spout 9 is held in fluid tight engagement with the body 11 by means of O-rings 18*a* and 18*b* as is shown in FIGS. 11 and 12 of the drawings.

Figure 12:
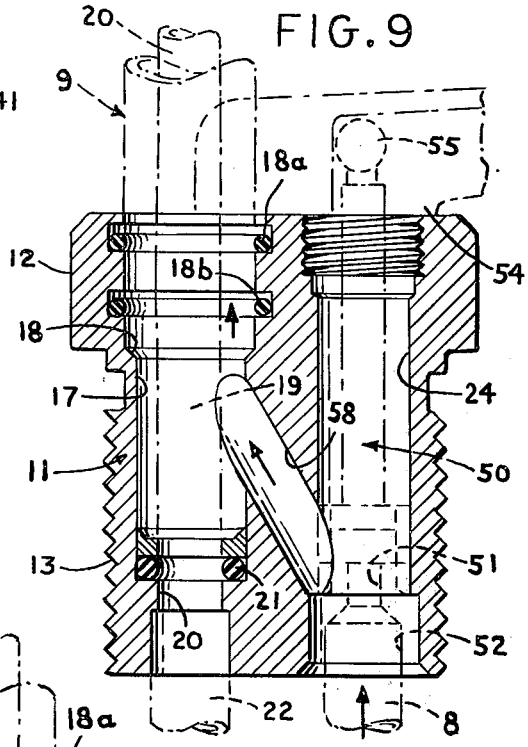
FIG. 12 is a cross-section taken on line 12—12 of FIG. 8 showing the discharge spout bore and the control valve bore for the chilled water control valve means and the cross-over passage therebetween to permit chilled water to flow to the discharge spout bore when the chilled water control valve means is actuated from closed to open position.
Figure 11:
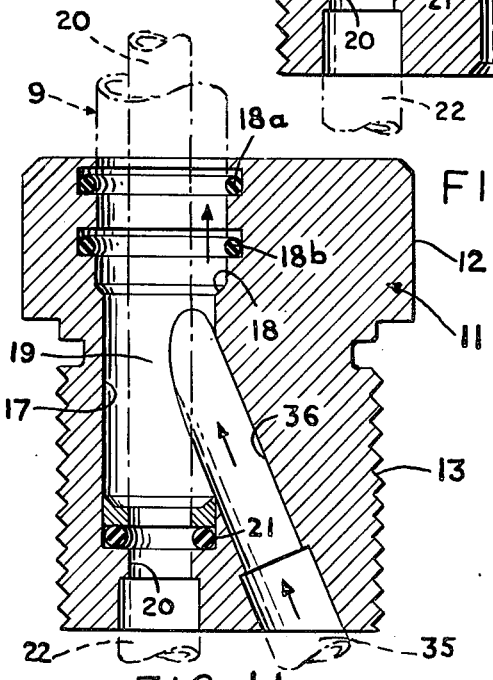
FIG. 11 is a cross-section taken on line 11—11 of FIG. 8 showing the connecting passage for connecting the discharge line from the heating and storing means with the discharge spout bore for delivering heated water to the discharge spout bore when the hot water control valve is actuated from closed to open position.

The discharge spout 9 is provided with a vent conduit 19 which extends beyond the base of the discharge spout as is shown in FIGS. 11 and 12 so that when the discharge spout 9 is in assembled position in the discharge spout bore 17 the vent conduit 19 will extend into a vent passage 20 which is disposed for communication with the discharge spout bore 17. The vent passage 20 is sealed as at 21 to prevent any discharging water or any backflow water from returning to the heating and storing means section 2 for heated water.

The venting passage 20 is connected to a venting conduit or line 22 which in turn communicates with the heating and storing means 2 and this acts to vent the heating and storing means section of the dispensing system to atmosphere. The importance of such an arrangement is well know and the reasons therefore are understood by those skilled in the art.

Disposed in spaced relation to the discharge spout bore 17 and to each other are a first control valve bore 23 and a second control valve bore 24 in which are mounted the respective first control valve assembly or means 10 for controlling the flow of water to be heated and of the heated water and the second control valve assembly or means 50 for controlling the flow of chilled water through the dispensing head 1 to the discharge spout 9 as is hereinafter described.

For the heated water section of the heated water and chilled water dispensing system, the first control valve bore 23 has an inlet port 25 and an outlet port 26. The inlet port 25 forms an inlet passage in the valve body to which the end of the connecting line 5 remote from the source line 4 is connected so that water to be heated is passed continuously through connecting lines 5 and the inlet passage 25 to the first control valve bore 23.

Since the first control valve assembly or means 10 is mounted to normally maintain the inlet port 25 closed, no water will pass through the first control valve bore 23 until the first control valve assembly or means 10 is moved to open position. This is accomplished by means of a manually operated heated water lever arm 27 which is pivotally mounted as at 28 so that one end 29 is connected to the first control valve assembly or means 10 and the other push section end 30 extends beyond the pivot on the opposite side of the point of connection to provide a manual lever on which a suitable indicia 31 designating the heated water control valve assembly or means 10 is provided. When the push section 30 is depressed the first control valve assembly or means 10 is moved to open position and water in the control valve bore 23 passes through the inlet port 25 to the outlet port 26.

Outlet port 26 communicates with an outlet passage 32 formed in the valve body 11 which is connected to one end of a transfer conduit 33. Transfer conduit 33 connects at the opposite end to the bottom of a heating and storage tank 34 in the heating and storage means 2 of the heated water and chilled water dispensing system.

Figure 13:
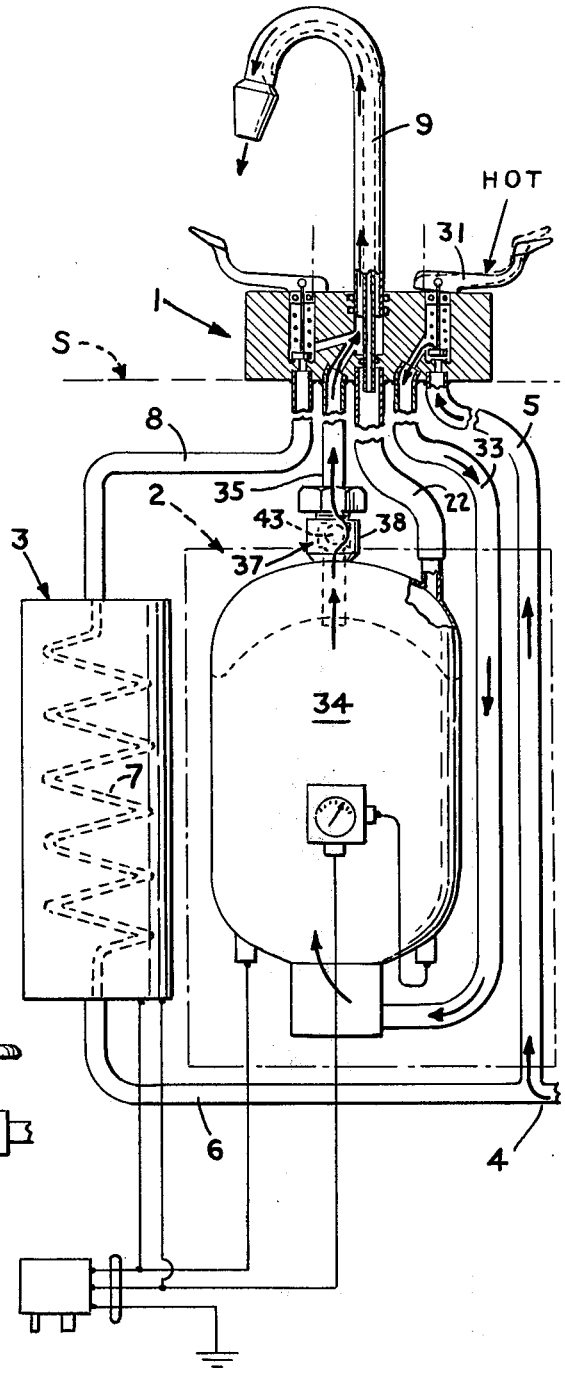
FIG. 13 is a schematic view of the dispensing head and the associated heated water and chilled water dispensing system shown in FIGS. 1 to 12 illustrating the flow path during the dispensing of heated water.

By reference to FIG. 13, the interrelation between the dispensing head 1 and the heating and storing means section 2 of the dispensing system will show how the heated water is displaced from the dispensing system through the dispensing head.

Thus when the push button section 30 of the heated water control valve assembly or means 10 is depressed to open inlet port 25 as is shown in FIG. 13, water flows from the source line 4 and connecting line 5 through the inlet port 25 and first control valve bore 23 to the outlet port 26 and hence through the transfer conduit 33 to the bottom of the heating and storage tank 34.

When water is delivered to the heating and storage tank 34 it acts to displace the heated fluid therein through a discharge line 35 connected at one end to the discharge outlet **35*a* for the heating and storage tank 34 and at the opposite end the discharge line communicates with the end of a cross-over passage 36 in the valve body 1. The opposite end of the cross-over passage 36 in turn communicates with and delivers the displaced heated water to the discharge spout bore 17. Heated water from the heating and storage tank 34 passed to the discharge spout bore 17 will then pass through the discharge spout 9** and be dispensed from the dispensing system.

Flow of heated water is terminated whenever the push section end 30 of the manual heated water lever arm 27 is released. This will close the inlet port 25. Since the flow of incoming source water to the bottom of the heating and storage tank 34 will also terminate further displacement of heated water from the heating and storage tank 34 ceases.

As in prior art devices some backflow of the heated water that fills the discharge spout 9; discharge spout bore 17, crossover passage 36 and discharge line 35 will occur on termination of the dispensing of heater water. This will also occur on termination of chilled water dispensing. Therefore a check valve means generally designated 37 is provided in the discharge circuit for the heated water. In the preferred form of the invention illustrated check valve means 37 is shown in the discharge line 35. It will be understood that the check valve means can be positioned at any point in the discharge circuit including for example in the discharge cross-over passage 36 in the valve body without departing from the scope of the present invention.

Check valve means 37 includes a valve body 38 having an end to end passage 39 therethrough in which a valve port is formed as at 40 by means of an O-ring 41 seated against a shoulder 42 in the valve body.

Coacting with the valve port 40 is a freely mounted hall 43 which has a specific gravity of less than 1 for reasons that will appear clear from the description set forth more fully below.

The freely mounted ball 43 is self seating on valve port 40 during the dispensing of chilled water to prevent flow of chilled water through passages 37 and discharge line 35 into the expansion chamber **35*a* for the heating and storage tank 34 by flowing through the aspirating means 35*b* in the discharge line 35 adjacent the discharge outlet 36.**

If backflow through the discharge line 35 during the dispensing of chilled water is not prevented, the chilled water would durng the dispensing of the chilled water ultimately fill the expansion chamber **35*a* and the associated vent system including vent line 22, vent passage 20 and vent conduit 19 and the resulting flow circuit through these passages would act to chill the top of the heating and storage tank 34** causing unnecessary heat losses.

The check valve ball 43 also seats itself on termination of dispensing of heated water or chilled water from the discharge spout 9 due to the inherent flow back or fall back of water which occurs on termination of either the chilled water dispensing cycle and/or the heated water dispensing cycle.

However, the flow back of water on termination when the dispensing system goes to the static or non-operating condition will not be detrimental because at smallvolume of flow back water collects in the expansion chamber **35*a* such water will be reheated therein and aspirated with the next dispensing cycle of heated water from the heating and storage tank 34.**

Figure 5:
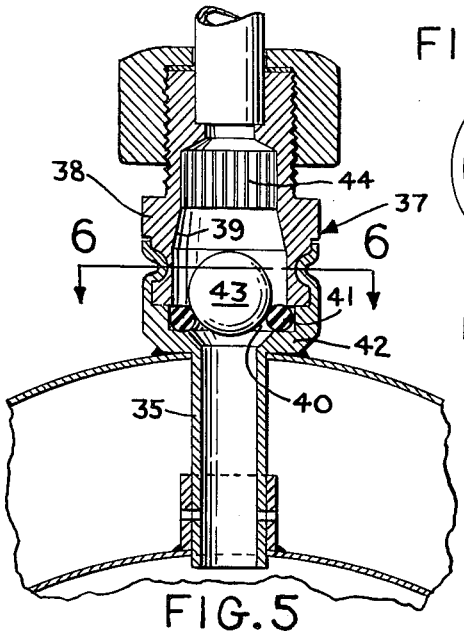
FIG. 5 is an enlarged view of the check valve means shown in FIG. 1 disposed between the heating and storing assembly of the dispensing system and the improved dispensing head in accordance with the present invention.
Figure 6:
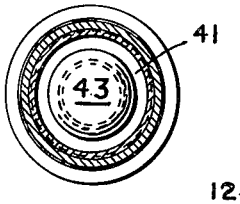
FIG. 6 is a cross-section taken on line 6—6 of FIG. 5.

FIG. 5 further shows that the end of the passage 39 in the valve body 38 remote from the valve port 40 contains a convoluted flow straightening element 44 which allows free flow of heated water around the freely mounted ball 43 and at the same time prevents ball 43 from escaping from the valve body 38 when heated water is being discharged through the discharge conduit 35.

However it is significant to the proper operation of the multi-control valve 1 in combination with the heated water and chilled water dispensing system that the check valve 43 have a specific gravity of less than 1 because this permits the check valve ball 43; where water is the fluid; to be self lifting during the dispensing of the heated water discharging through the discharge line 35.

If check valve ball 43 is self lifting the back pressure in the discharge line 35 is minimized and the differential pressure across the aspirator can maintain maximum operating efficiency.

If any significant back pressure is exerted by the check valve bore 43 in the discharge line 35 a sufficiently high differential pressure will be imposed across the aspirator 35*b* to generate a positive pressure at the aspirator inlet rather than a negative pressure as occurs when the ball 43 has a specific gravity of less than 1. Positive pressure would cause heated discharging through line 35 to flow into the expansion chamber and out through the vent system instead of through the discharge line 35 and the system would therefore not operate efficiently nor properly.

For the chilled water section of the heated water and chilled water dispensing system, the second control valve bore 24 is provided with an inlet port 51 for chilled water. The inlet port 51 communicates with an inlet passage 52 and this permits the end of the connecting conduit 8 remote from the end connected to the heat exchanger to be connected to the valve body 11 so that it communicates with the inlet passage 52.Therefore chilled water at all times will fill the line 8, inlet passage 52 and inlet port 51 which inlet port is maintained normally closed by he chilled water control valve assembly or means 50.

Since the chilled water control valve assembly or means 50 is mounted to normally maintain the inlet prot 51 closed no chilled water will pass into the chilled water control valve bore 24 until the second or chilled water control valve assembly or means 50 is moved to open position. This is accomplished by means of a manually operated chilled water lever arm 53 which is pivotally mounted as at 54 adjacent to the heated water lever arm 27. One end of the chilled water lever arm 53 is connected as at 55 to the second or chilled water control valve assembly or means 50 and the other end as at 56 extends outward or beyond the pivot on the side opposite from the end connected to the chilled water control valve assembly or means 50 to provide a manually operated push section end 56 on which there is provided a suitable indicia 57 for designating the chilled water control valve assembly or means 50.

Figure 14:
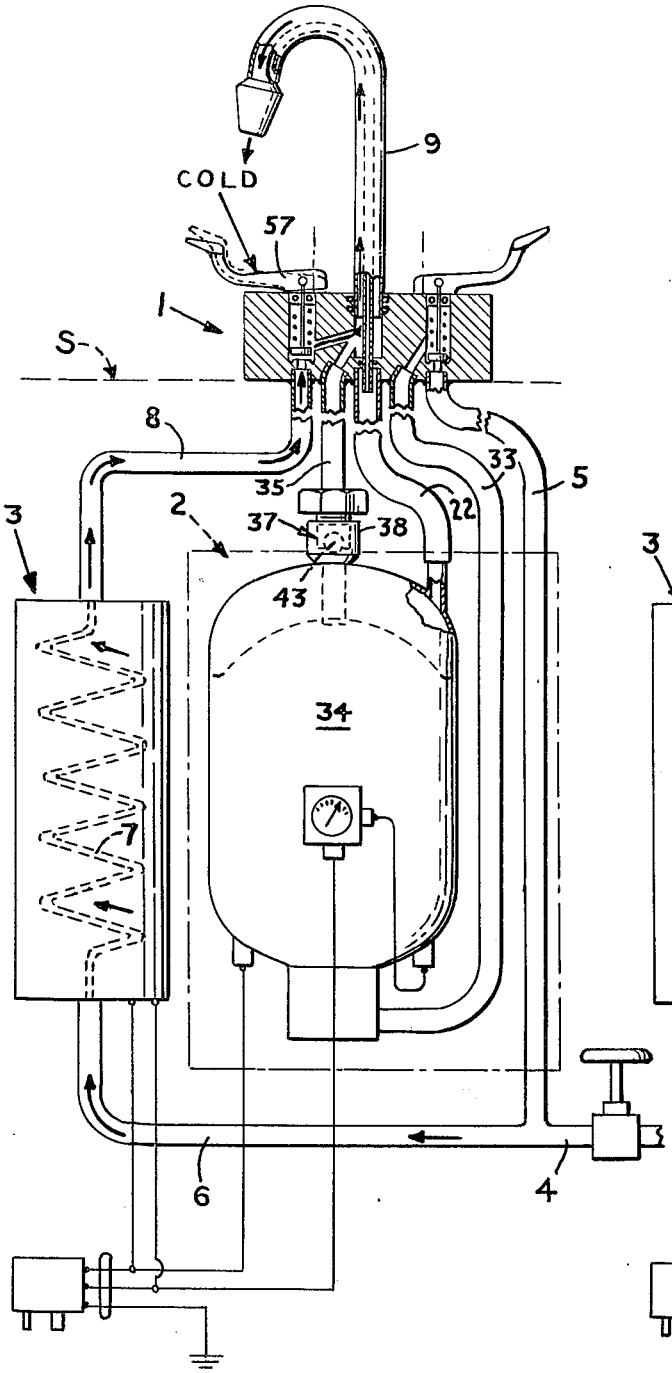
FIG. 14 is a schematic view of the dispensing head and the associated heated water and chilled water dispensing system shown in FIGS. 1 to 12 illustrating the flow path during the dispensing of chilled water.

By reference to FIG. 14 the operation of the chilled water side of the system will be clear.

Thus when the push botton section 56 is depressed the second control valve assembly or means 50 is moved to open position and the chilled water continuously present in the connecting conduit 8 and inlet passage 52 will flow through inlet port 51 into the second control valve bore 24.

The second control valve bore 24 communicates through a second cross-over passage 58 with the discharge spout bore 17. Since the second cross-over passage 58 is on the downstream side of the second control valve assembly means 50 chilled water delivered into the second control valve bore 24 will automatically flow therethrough to the second cross-over passage 58 and into the discharge spout bore 17 and the discharge spout 9 to be dispensed for any desired application or use.

When the chilled water operating lever 53 is released flow into the second control valve bore 24 will terminate as soon as the chilled water inlet port 51 is closed. However, because of the water filling the discharge spout bore 17 and the discharge spout 9 a relatively small quantity of chilled water will flow back through the discharge spout 9 and discharge spout bore 17 and some of this water will pass into and intermingle with the small quantity of heated water that is caught by the check valve 37 which remains in the discharge line 35 from the heating and storage tank 34.

The area of contact at the interface of these two fluids will be so small as to be negligible for the heated water and chilled water dispensing system as above described so that the intermixing across this area of contact will be quite small and the energy loss due thereto will be inconsequential.

Due to the extremely small volume of water involved at the flow rate for dispensing systems of this type it will take approximately 2/10 to 3/10 of a second to discharge this slug of water on the next dispensing cycle.

Since this is a shorter period of time then is required for instance to stabilize the temperature of the mass of the dispensing spout 9 and the valve body 11 from ambient temperature to hot dispsnsing temperature conditions or cold dispensing temperature conditions it will be clear that the thermal dilution due to this small volume of heated water trapped above the check valve 37 in discharge line 35 will have no adverse affect on the opperation of the dispensing head in accordance with the present invention or the heated water and chilled water dispensing system utilizing the same.

It is also noted that in tests it was determined that most people automatically wait a few seconds by force of habit before placing their cup into receiving position under the discharge spout 9 for either heated water or chilled water.

Further it is thought obvious that mixtures of heated water and chilled water can be obtained by depressing the heated water operating lever 27 and chilled water operating lever 53 at the same time to the degree required for the desired mixture.

The juxtaposition therefore of these respective operating levers 27 and 53 not only provides a pleasing cosmetic appearance but further permits this mixing type operation of heated water and chilled water if requied in addition to the separate and independent dispensing of respectively heated water or chilled water as may be desired.

The dispensing head above described either alone or in combination with a dispensing system of the type illustrated is applicable to the dispensing of any heated fluid and chilled fluid dispensing system but to insure proper operation where an aspirator is used as shown herein the check valve ball must have a specific gravity less than that of the heated fluid being dispensed.

It will be understood that the invention is not to be limited to the specific construction or arrangement of parts shown but that they may be widely modified within the invention defined by the claims.

What is claimed is:

1. A dispensing head for use in a heated fluid and chilled fluid dispensing system.

a. a valve body having connecting means for attaching the dispensing head at a point generally remote from the dispensing system, b. said valve body having a common discharge spout for heated water and chilled water delivered thereto, c. a first normally closed control valve assembly and a second normally closed control valve assembly disposed in said valve body in spaced relation to each other and respectively to the discharge spout, d. a first cross-over passage in said valve body in communication with the discharge spout for delivering heated fluid thereto to be dispensed, e. said first control valve assembly operatively associated with the first cross-over passage to control the flow of heated fluid thereto from said dispensing system when said first control valve assembly is actuated from closed to open position and to terminate dispensing of said heated fluid when actuated from open to closed position, f. a second cross-over passage in said valve body connecting the second control valve assembly to the discharge spout for deliverying chilled water thereto to be dispensed, g. said second control valve assembly operatively associated with the second cross-over passage to control the flow of chilled fluid thereto from said dispensing system when said second control valve assembly is actuated from closed to open position and to terminate dispensing of said chilled water when actuated from open to closed position, and h. check valve means connected to the valve body operative to prevent unwanted intermixing of heated water and chilled water during the delivery of chilled water and mixtures thereof.

2. In a dispensing head as claimed in claim 1 wherein, said check valve means includes, a check valve ball having a specific gravity less than that of the heated fluid to be dispensed through the dispensing head.

3. In a dispensing head as claimed in claim 2 wherein the check valve ball has a specific gravity less than 1.

4. In a dispensing head as claimed in claim 1 wherein, a. first operating lever means connected to the first control valve means for actuating the same between the closed position and the open position, and b. second operating lever means connected to the second control valve means for actuating the same between the closed position and the open position, and c. said first operating lever means and said second operating lever means disposed in juxtaposition to each other and to said common discharge spout.

5. In a dispensing head as claimed in claim 4 wherein said check valve means includes a check valve ball having a specific gravity less than that of the heated fluid to be dispensed through the dispensing head.

6. In a dispensing head as claimed in claim 5 wherein the check valve ball has a specific gravity less than 1.

7. In a dispensing head as claimed in claim 1 wherein the valve body has a vent means therein.

8. In a dispensing head as claimed in claim 1 having, a. a discharge spout bore in the valve body, b. a first control valve bore and a second control valve bore in said valve body in spaced relation to each other and respectively spaced from the discharge spout bore, c. said first control valve assembly mounted in said first control valve bore and second control valve assembly mounted in said second control valve bore, and d. a first operating lever for said first control valve assembly and a second operating lever for said second control valve assembly, e. said first operating lever and said second operating lever pivotally mounted on the valve body and disposed adjacent to each other, f. first indicia means on the first operating lever to designate that the associated first control valve assembly controls the flow of heated fluid delivered to the discharge spout, and g. second indicia means on the second operating lever to designate that the associated second control valve assembly controls the flow of chilled liquid delivered to the discharge spout.

9. In a dispensing head as claimed in claim 8 wherein the check valve means includes a check valve ball having a specific gravity less than the heated fluid being dispensed by the dispensing head.

10. In a dispensing head as claimed in claim 9 wherein the check valve ball has a specific gravity less than 1.

11. In a dispensing head as claimed in claim 7 wherein, a. said valve body has a vent opening therein, and b. said vent opening is in alignment with the discharge spout bore, c. a vent passage in the discharge spout extending outboard of the connecting end of the discharge spout, and d. said discharge spout removably connectible into the discharge spout bore and said vent passage therein disposed to communicate with the vent opening in the valve body when the discharge spout is in assembled position.

12. The combination of a multi-control valve dispensing head with a heated fluid and chilled fluid dispensing system wherein, a. said heated fluid and chilled fluid dispensing system includes, 1. heating and storing means for heated fluid, and
2. chilling and storing means for chilled fluid, b. and said multi-control valve dispensing head includes, 1. a valve body having means for connecting the valve body to a point of use remote from the heated fluid and chilled fluid dispensing system,
2. a common discharge spout in said valve body for dispensing heated fluid and chilled fluid delivered thereto,
3. a first cross-over passage in communication with said common discharge spout for passing heated fluid thereto,
4. a first normally closed control valve assembly operatively associated with the first cross-over passage to control flow of heated fluid thereto from said heating and storage means when said first control valve assembly is actuated to open position and to terminate flow of said heated fluid when said control valve assembly is moved to closed position.
5. a second cross-over passage in communication with said common discharge spout for passing chilled fluid thereto,
6. a second normally closed control valve assembly operatively connected to the second cross-over passage to control flow of chilled fluid thereto from said chilling and storage means when the second control valve assembly is actuated to open position and to terminate flow of said chilled fluid thereto when the second control valve assembly is moved to closed position, and c. check valve means operatively connected to said dispensing head and operative to prevent unwanted intermixing of heated water and chilled water during the delivery of chilled water and mixtures thereof.

13. In a dispensing head as claimed in claim 12 wherein, said check valve means includes, a check valve ball having a specific gravity less than that of the heated fluid to be dispensed through the dispensing head.

14. In a dispensing head as claimed in claim 13 wherein the check valve ball has a specific gravity less than 1.

15. In the combination as claimed in claim 12 wherein the valve body of the multi-control valve dispensing head as a vent means therein operatively associated with the dispensing of heated fluid from said dispensing system to vent the same to atmosphere.

16. In a dispensing head as claimed in claim 15 wherein, said check valve means includes, a check valve ball having a specific gravity less than that of the heated fluid to be dispensed through the dispensing head.

17. In a dispensing head as claimed in claim 16 wherein the check valve ball has a specific gravity less than 1.

18. In the combination as claimed in calim 12 wherein, a. a discharge spout bore in the valve body, b. a first control valve bore and a second control valve bore in said valve body in spaced relation to each other and respectively spaced from the discharge spout bore, c. said first control valve assembly mounted in said first control valve bore and second control valve assembly mounted in said second control valve bore, and d. a first operating lever for said first control valve assembly and a second operating lever for said second control valve assembly, e. said first operating lever and said second operating lever pivotally mounted on the valve body and disposed adjacent to each other, f. first indicia means on the first operatng lever to designate that the associated first control valve assembly controls the flow of heated fluid delivered to the discharge spout, and g. second indicia means on the second operating lever to designate that the associated second control valve assembly controls the flow of chilled liquid delivered to the discharge spout.

19. In a dispensing head as claimed in claim 18 wherein, said check valve means includes, a check valve ball having a specific gravity less than that of the heated fluid to be dispensed through the dispensing head.

20. In a dispensing head as claimed in claim 19 wherein the check valve ball has a specific gravity less than 1.

21. In the combination as claimed to claim 18 wherein, a. said valve body has a vent opening therein, and b. said vent opening is in alignment with the discharge spout bore, c. a vent passage in the discharge spout, d. said discharge spout removably connectible in the discharge spout bore and said vent passage therein disposed to communicate with the vent opening in the valve body when the discharge spout is in assembled position operative to the vent heated fluid from the said dispensing system to atmosphere.

22. In a dispensing head as claimed in claim 21 wherein, said check valve means includes, a check valve ball having a specific gravity less than that of the heated fluid to be dispensed through the dispensing head.

23. In a dispensing head as claimed in claim 22 wherein the check valve ball has a specific gravity less than 1.

* * * * *